United States Patent [19]

Lelental et al.

[11] 4,332,875

[45] Jun. 1, 1982

[54] POLYMERIC ELECTRICALLY ACTIVE CONDUCTIVE LAYER FOR ELECTRICALLY ACTIVATABLE RECORDING ELEMENT AND PROCESS

[75] Inventors: Mark Lelental, Penfield; Richard C. Sutton, Rochester, both of N.Y.

[73] Assignee: Eastman Kodak Company, Rochester, N.Y.

[21] Appl. No.: 229,701

[22] Filed: Jan. 29, 1981

Related U.S. Application Data

[63] Continuation-in-part of Ser. No. 156,712, Jun. 5, 1980, abandoned, which is a continuation-in-part of Ser. No. 124,189, Feb. 25, 1980, abandoned.

[51] Int. Cl.[3] ..... G03G 5/026; G03G 5/04

[52] U.S. Cl. ..... 430/45; 430/55; 430/56; 430/60; 430/62; 430/97; 430/353; 430/413

[58] Field of Search ..... 430/55, 56, 60, 62, 430/84, 97, 42, 353, 413, 45

[56] References Cited

U.S. PATENT DOCUMENTS

| | | | |
|---|---|---|---|
| 2,258,423 | 10/1941 | Rust | 526/232 |
| 2,361,019 | 10/1944 | Gerhart | 526/272 |
| 3,370,212 | 2/1968 | Frank | 361/229 |
| 3,428,451 | 2/1969 | Trevoy | 430/62 |
| 3,428,451 | 2/1969 | Trevoy | 430/63 |
| 3,577,272 | 5/1971 | Reithel | 427/74 |
| 3,615,414 | 10/1971 | Light | 430/74 |
| 3,640,708 | 2/1972 | Humphriss et al. | 430/64 |
| 3,880,657 | 4/1975 | Rasch | 430/62 |
| 3,880,657 | 5/1975 | Rasch | 430/63 |
| 3,978,335 | 8/1976 | Gibbons | 430/350 |
| 4,113,484 | 9/1978 | Lelental et al. | 430/902 |
| 4,123,274 | 10/1978 | Knight et al. | 430/336 |
| 4,128,577 | 12/1978 | Nelson | 564/171 |
| 4,155,760 | 5/1979 | Lelental et al. | 430/55 |
| 4,155,761 | 5/1979 | Lelental et al. | 430/900 |

FOREIGN PATENT DOCUMENTS

| | | |
|---|---|---|
| 2745696 | 5/1978 | Fed. Rep. of Germany . |
| 1512024 | 5/1978 | United Kingdom . |

OTHER PUBLICATIONS

Research Disclosure, Oct. 1979, Item Nos. 18654, 18627.

Research Disclosure, Aug. 1973, Item No. 11210.

"Electrophotography", by R. M. Schaffert, (1965).

"Xerography and Related Processes", by Dessauer and Clark, (1965).

"Neblette's Handbook of Photography and Reprography", edited by J. M. Sturge, 7th Edition, 1977, pp. 120-121.

Research Disclosure, Dec. 1978, Item No. 17643.

U.S. application Ser. No. 61,541, (now abandoned) of Lelental et al., filed Jul. 27, 1979.

U.S. application Ser. No. 55,945 of Lelental, filed Jul. 9, 1979.

Research Disclosure, Sep. 1978, Item No. 17326.

Research Disclosure, Oct. 1976, Item No. 15026.

Research Disclosure, May 1977, Item Nos. 15733, 15732, 15776 and 15734.

*Primary Examiner*—Richard L. Schilling
*Assistant Examiner*—John L. Goodrow
*Attorney, Agent, or Firm*—Richard E. Knapp

[57] ABSTRACT

In an electrically activatable recording element, such as one comprising an electrically conductive support having thereon, in sequence: (a) a polymeric electrically active conductive (EAC) layer, (b) an electrically activatable recording layer comprising (A) a dye-forming coupler, and (B) an oxidation-reduction combination comprising (i) an organic silver salt oxidizing agent consisting essentially of a silver salt of a 1,2,4-mercaptotriazole derivative, with (ii) a reducing agent which, in its oxidized form, forms a dye with the dye-forming coupler, (c) a photoconductive layer separated from (b) by an air gap of up to 20 microns, and (d) an electrically conductive layer; improvements are provided by means of a polymeric EAC layer (a) consisting essentially of a vinyl addition polymer, such as poly(methyl acrylate-co-vinylidene chloride). The recording element is room light handleable and provides a dye image and silver image by dry development processing.

28 Claims, 5 Drawing Figures

LATENT IMAGE FORMATION

HEAT DEVELOPMENT

LATENT IMAGE FORMATION

POLYMERIC ELECTRICALLY ACTIVE CONDUCTIVE LAYER FOR ELECTRICALLY ACTIVATABLE RECORDING ELEMENT AND PROCESS

This application is a continuation-in-part of U.S. application Ser. No. 156,712, filed June 5, 1980, now abandoned which is a continuation-in-part of U.S. application Ser. No. 124,189, filed Feb. 25, 1980, now abandoned.

BACKGROUND OF THE INVENTION

1. Field of the Invention

This invention relates to a dye-forming charge-sensitive recording element and process. One aspect of the invention relates to the use of a vinyl addition polymer in the electrically active conductive layer, referred to herein as a polymeric EAC layer, in a charge-sensitive recording element which is capable of producing a dye image and silver image by dry development processes.

2. Description of the State of the Art

Production of a dye image and silver image in an electrically activatable recording material by dry development techniques is described in copending U.S. application Ser. No. 055,945, of M. Lelental, filed July 9, 1979, titled "Dye Forming Electrically Activated Recording Material and Process", now abandoned and commonly assigned with the present application to Eastman Kodak Company, and *Research Disclosure,* October 1979, Item 18627. In accordance with that invention, production of a dye image and silver image is accomplished by means of an electrically activated recording element comprising an electrically conductive support, such as a poly(ethylene terephthalate) film having a cermet coating on the film, having thereon, in sequence, (a) an electrically activated recording layer comprising an organic silver salt and a reducing agent, and (b).a photoconductive layer separated from (a) by an air gap of up to 20 microns and (c) an electrically conductive layer on (b), wherein the recording layer comprises, in reactive association, (A) a dye-forming coupler, and (B) an oxidation-reduction combination comprising (i) an organic silver salt oxidizing agent, with (ii) a reducing agent which, in its oxidized form, forms a dye with the dye-forming coupler. Such an electrically activated recording element enables formation of a dye image and silver image by heat processing after imagewise exposure. It has been desirable to increase the charge sensitivity of such elements. Increased charge sensitivity would lower the levels of charge required to form a latent image in the electrically activated recording layer.

In our attempt to increase charge sensitivity, we found that a polymeric layer between the electrically conductive support and the electrically activated recording layer could provide some increased charge sensitivity. However, as indicated in the following comparative examples, many polymeric materials do not provide a suitable increase in charge sensitivity. No answer to the problem of producing the desired degree of increased charge sensitivity by means of some type of interlayer or some type of polymer in a subbing layer was clear from the art.

SUMMARY OF THE INVENTION

It has been found according to the invention that increased charge sensitivity can be obtained in an electrically activatable recording element, such as one comprising an electrically conductive support having thereon, in sequence:

(a) a polymeric electrically active conductive (EAC) layer, (b) an electrically activatable recording layer comprising (A) a dye-forming coupler, and (B) an oxidation-reduction combination comprising (i) an organic silver salt oxidizing agent consisting essentially of a silver salt of a 1,2,4-mercaptotriazole derivative, especially such a derivative represented by the structure:

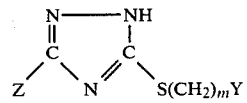

wherein Y is aryl containing 6 to 12 carbon atoms, m is 0 to 2; and, Z is hydrogen, hydroxyl, or amine, with (ii) a reducing agent which, in its oxidized form, forms a dye with the dye-forming coupler, (c) a photoconductive layer separated from (b) by an air gap of up to 20 microns, and (d) an electrically conductive layer.

The increased charge sensitivity is provided by means of a polymeric EAC layer (a) that comprises a vinyl addition polymer comprising recurring units represented by the structure:

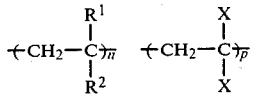

wherein $R^1$ is hydrogen or methyl; $R^2$ is aryl containing 6 to 10 carbon atoms, such as phenyl and naphthyl, or

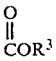

wherein $R^3$ is alkyl containing 1 to 20 carbon atoms, such as methyl, ethyl, propyl and butyl, or aryl containing 6 to 10 carbon atoms, such as phenyl and naphthyl; each X is bromine or chlorine; n represents 15 to 50 weight percent, and p represents 50 to 85 weight percent of said vinyl addition polymer. The term "alkyl" includes straight chain alkyl and branched chain alkyl. The alkyl groups can be substituted by means of groups that do not adversely affect the desired properties of the electrically activated recording element, such as an oxo group. The term "alkyl" includes such groups.

It has also been found according to the invention that a dye image and silver image, especially a dye enhanced silver image, can be produced by a dry, electrically activated recording process comprising the steps of (I) imagewise applying an electric potential, of a magnitude and for a time sufficient to produce in the image areas a charge density within the range of about $10^{-5}$ coulomb/cm$^2$ to about $10^{-8}$ coulomb/cm$^2$ to an electrically activatable recording layer of a charge-sensitive recording element, having a vinyl addition polymer EAC layer according to the invention, the charge density forming a developable latent image in the charge-sensitive recording layer; and, then (II) heating the element substantially uniformly at a temperature and for a time sufficient to produce a dye image and silver image in the recording layer. In this process embodiment, other means than a photoconductor are useful to produce the desired charge density in the recording layer, such as a contact or non-contact electrode.

A further process according to the invention which produces a dye image and silver image comprises (I) imagewise altering the conductivity of the photoconductive layer of the electrically activatable recording element according to the invention in accord with an image to be recorded; (II) applying across the photoconductive layer and recording layer an electrical potential of a magnitude and for a time sufficient to produce a developable latent image in the recording layer corresponding to the image to be recorded; and then (III) heating the recording layer substantially uniformly at a temperature and for a time sufficient to produce a dye image and a silver image, preferably a dye enhanced silver image, in the recording layer. The step (I) of imagewise altering the conductivity of the photoconductive layer is preferably carried out while simultaneously (II) applying the described electrical potential across the photoconductive layer and recording layer.

A further process according to the invention is a dry, electrically activated recording process for producing a dye image and silver image, preferably a dye enhanced silver image, in an electrically activatable recording element, having a vinyl addition polymer EAC layer according to the invention, comprising the steps: (I) imagewise altering the conductivity of a photoconductive layer in accord with an image to be recorded; (II) positioning the imagewise altered photoconductive layer from (I) in face-to-face relationship with an electrically activatable recording layer of the recording element; (III) applying across the photoconductive layer and recording layer an electrical potential of a magnitude and for a time sufficient to produce in the areas of the recording layer corresponding to the imagewise altered portions of the photoconductive layer a charge density within the range of about $10^{-5}$ coulomb/cm$^2$ to about $10^{-8}$ coulomb/cm$^2$, the charge density forming in the areas a developable latent image; and then (I) uniformly heating the recording element at a temperature and for a time sufficient to produce a dye image and silver image, especially a dye enhanced silver image, in the recording element.

Another process according to the invention is a dry electrically activated recording process for producing a dye image and silver image, preferably a dye enhanced silver image, in a charge-sensitive recording element having a vinyl addition polymer EAC layer according to the invention, preferably having ohmic resistivity within the range of about $10^4$ to about $1\times10^{12}$ ohm-cm, containing at least one electrically activatable recording material comprising in an electrically conductive binder, (A) a dye-forming coupler, and (B) an image-forming combination comprising (i) an organic silver salt oxidizing agent consisting essentially of a silver salt of a 1,2,4-mercaptotriazole derivative, with (ii) a reducing agent which, in its oxidized form, forms a dye with the dye-forming coupler; comprising the steps: (I) positioning the recording material on an electrically conductive backing member; (II) modulating a corona ion current flow to the recording element by an electrostatic field established imagewise between an image grid comprising an electroconductive core sequentially connectable to sources of different potential relative to the backing member and covered with a coating of a photoconductive insulating material and a control grid that is electrically conductive and sequentially connectable to sources of different potential relative to the backing member, said current flow being of a magnitude sufficient to produce a charge density within the range of about $10^{-5}$ to about $10^{-8}$ coulomb/cm$^2$ imagewise in said recording element, which charge density forms a developable latent image in the electrically activated recording material; and, (III) substantially uniformly heating the recording element at a temperature and for a time sufficient to produce a dye enhanced silver image in the recording element.

The heating step in each of the described process embodiments is carried out at a temperature within the range of about 80° C. to about 200° C., typically at a temperature within the range of about 100° C. to about 180° C., until the desired silver image and dye image are formed.

DETAILED DESCRIPTION OF THE INVENTION

Figure 1:
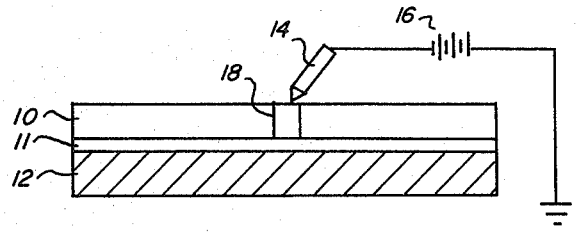
FIGS. 1 and 2 illustrate schematically an image recording material and process according to one illustrative embodiment of the invention.

The term "electrically active conductive" herein has been abbreviated as "EAC". This term describes a layer according to the invention which is located between the electrically activatable recording layer (the layer in which a latent image is formed) and the electrically conductive support of an element according to the invention. This EAC layer is defined as electrically active because the desired degree of increased sensitivity to the image recording layer is produced when electrical charge is passed through the layers during imagewise exposure.

Many vinyl addition polymers having the described recurring units are useful as the EAC layer in an electrically activated element according to the invention. The exact mechanisms by which the latent image is formed and by which the EAC layer enables increased charge sensitivity in an element according to the invention are not fully understood. It is postulated that the injection of a charge carrier due to the electric field into the combination of components results in the formation of a developable latent image in the electrically activated recording layer. Some form of interaction which is not fully understood occurs between the electrically activated recording layer and the EAC layer. For reasons not fully understood, the image apparently forms in the exposed areas in the recording layer closest to the interface between the electrically activated recording layer and the EAC layer in an element according to the invention, rather than uniformly through the exposed areas of the electrically activated recording layer. It is believed that the development of the latent image is accomplished by a reaction in which the latent image catalyzes the reaction of the described image-forming combination. In such a reaction, the organic silver salt oxidizing agent reacts with the reducing agent. Then, the oxidized form of the reducing agent resulting from this reaction in turn reacts with the dye-forming coupler to produce a dye in the image areas. It is not entirely clear, however, what part, if any, the dye-forming coupler and the other described components play in latent image formation.

While many image recording combinations containing the described components are useful, the optimum image recording combination and image recording element will depend upon such factors as the desired image, the particular dye-forming coupler, the particular organic silver salt oxidizing agent and reducing agent, the source of exposing energy, processing condition ranges and the like.

The term "charge-sensitive recording element" as used herein means an element which when subjected to an electrical current undergoes a chemical and/or electrical change which provides a developable latent image.

The term "latent image" as used herein is intended to mean an image that is not visible to the unaided eye or is faintly visible to the unaided eye and that is capable of amplification in a subsequent processing step, especially in a subsequent heat development step.

The term "resistive recording material" as used herein is intended to mean a material that has an ohmic resistivity of at least about $10^4$ ohm-cm.

The term "electrically conductive" such as in "electrically conductive support" or "polymeric electrically active conductive (EAC) layer" is intended herein to mean a support and EAC layer that have a resistivity less than about $10^{12}$ ohm-cm.

The vinyl addition polymers useful in an electrically activated recording element according to the invention are prepared by methods known in the polymer art. The following preparation of poly(methyl acrylate-covinylidene chloride) (20:80 weight ratio) is illustrative of methods that are used for preparing such polymers: To a 7.57 liter stainless steel reactor equipped with a stirrer, condenser, baffle and heated jacket is added 4.0 Kg of distilled water and 4.5 g $K_2S_2O_8$. The solution is deoxygenated such as by evacuation four times to boiling with release of pressure using nitrogen gas. The reactor mixture is cooled to 15° C.; and 150 grams of surfactant, such as a sodium salt of an alkylarylpolyether sulfate available under the trade name TRITON 770 from the Rohm and Haas Co., U.S.A., vinylidene chloride (1440 grams) and methyl acrylate (360 grams) are added. Stirring of the reactor contents is maintained throughout the procedure. An additional 200 grams of distilled water containing 2.26 grams of dissolved $Na_2S_2O_5$ is added and the reactor sealed and heated to 35° C. The temperature is maintained at 35° C. for 17 hours at a pressure of 170 KPa. The reactor contents are cooled to produce a latex solution of 27.8 percent solids. The polymer is isolated by means of a freeze-thaw technique, washed with distilled water three times using 60 liters of water per wash, centrifuged, and dried at 40° C. in vacuum for 17 hours. The resulting desired polymer has an inherent viscosity in cyclohexane of 0.93 with a Tg of 31° C.

Many photoconductors are useful in an element according to the invention. Selection of an optimum photoconductor will depend upon such factors as the particular electrically activatable recording layer, the charge sensitivity of the element, the desired image, the ohmic resistivity desired, exposure means, processing conditions and the like. It is advantageous to select a photoconductor which has the property of being the most useful with the operative voltages to be used for imaging. The photoconductor is either an organic photoconductor or an inorganic photoconductor. Combinations of photoconductors may be used. The resistivity of the photoconductor can change rapidly in the operating voltage ranges that may be used. In some cases, it is desirable that the photoconductor layer have what is known in the art as persistent conductivity. Examples of useful photoconductors include lead oxide, cadmium sulfide, cadmium selenide, cadmium telluride and selenium. Useful organic photoconductors include, for instance, polyvinyl carbazole/trinitrofluorenone photoconductors and aggregate type organic photoconductors described in, for example, U.S. Pat. No. 3,615,414. These photoconductors are known in the image recording art and are described in, for example, U.S. Pat. No. 3,577,272; *Research Disclosure,* August 1973, Item 11210 of Reithel, published by Industrial Opportunities Ltd., Homewell, Havant, Hampshire, P09 1EF, U.K.; "Electrography" by R. M. Schaffert (1975) and "Xerography and Related Processes" by Dessauer and Clark (1965) both published by Focal Press Limited, and U.S. Pat. No. 3,615,414.

An especially useful photoconductive layer comprises a dispersion of a lead oxide photoconductor in an insulating binder, such as a binder comprising a polycarbonate (for example, LEXAN, a trademark of General Electric Company, U.S.A., consisting of a Bisphenol A polycarbonate), polystyrene or poly(vinyl butyral).

A recording element according to the invention is especially useful wherein the photoconductive layer is X-ray sensitive and the conductivity of the photoconductive layer can be imagewise altered by imagewise exposing the photoconductive layer to X-ray radiation.

Many dye-forming couplers are useful in the element and process according to the invention. The exact mechanism by which the dye image and silver image are produced is not fully understood. However, it is believed that the dye-forming coupler reacts with the oxidized form of the reducing agent to form a dye. The term dye-forming coupler herein means a compound or combination of compounds which with other of the components produces a desired dye image upon heating the recording layer after exposure. There are designated as dye-forming couplers because it is believed that the compounds couple with the oxidized developer to produce the dye. The dye-forming couplers described herein are also known in the photographic art as color-forming couplers. Selection of a suitable dye-forming coupler will be influenced by such factors as the desired dye image, other components of the recording layer, processing conditions, particular reducing agent in the recording layer and the like. An example of a useful magenta dye-forming coupler is 1-(2,4,6-trichlorophenol)-3-[3-]α-(3-pentadecylphenoxy)-butyramido [benzamido]-5-pyrazolone. A useful cyan dye-forming coupler is 2,4-dichloro-1-naphthol. A useful yellow dye-forming coupler is α-[3-{α-(2,4-di-tertiary-amylphenoxy) acetamido}-benzoyl]-2-fluoroacetanilide. Useful cyan, magenta and yellow dye-forming couplers can be selected from those described in, for example, "Neblette's Handbook of Photography and Reprography", edited by John M. Sturge, 7th Edition, 1977, pages 120–121 and *Research Disclosure,* December 1978, Item 17643, Paragraphs VII C-G.

An especially useful dye-forming coupler is a resorcinol dye-forming coupler. The resorcinol dye-forming coupler is preferably one that produces a neutral (black) or nearly neutral appearing dye with the oxidized form of the described reducing agent. Monosubstituted resorcinol dye-forming couplers containing a substituent in the two position are especially useful. The resorcinol dye-forming coupler and other components in the recording layer should be sufficiently stable to avoid any significant adverse interaction in the recording layer prior to imagewise exposure and processing. Many resorcinol dye-forming couplers are useful. A useful resorcinol dye-forming coupler is one represented by the formula:

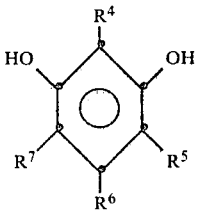

wherein $R^4$ is hydrogen, $$\overset{O}{\overset{\|}{C}}OH,\quad NH\overset{O}{\overset{\|}{C}}R^8,\quad \overset{O}{\overset{\|}{C}}R^9,\quad \text{or}\quad NHSO_2R^{10};$$

$R^5$ is hydrogen, $$\overset{O}{\overset{\|}{C}}OH,\quad \overset{O}{\overset{\|}{C}}NHCH_2CH_2OH,\quad \text{or}\quad \overset{O}{\overset{\|}{C}}NH\text{-}C_6H_5\text{-}OC_5H_{11}n;$$

$R^6$ is hydrogen, $$NH\overset{O}{\overset{\|}{C}}R^8,\quad \text{or}\quad \overset{O}{\overset{\|}{C}}R^9;$$

$R^7$ is hydrogen, $$\overset{O}{\overset{\|}{C}}OH,\quad \overset{O}{\overset{\|}{C}}NHCH_2CH_2OH,\quad \text{or}\quad \overset{O}{\overset{\|}{C}}NH\text{-}C_6H_5\text{-}C_5H_{11}n;$$

$R^8$ is haloalkyl containing 1 to 3 carbon atoms, such as $CCl_3$, $CF_3$ and $C_3H_4Br_3$, $CH_2OCH_3$, $CH_2SR^{10}$, $NHR^{11}$, $C_2H_4COOH$, $CH{=}CH_2$, $NHC_2H_4Cl$, alkyl containing 1 to 20 carbon atoms, such as 1 to 10 carbon atoms, including methyl, ethyl, propyl and decyl, or phenyl;

$R^9$ is OH, $NH_2$, $NHCH_2CH_2OH$ and $NH(C_6H_5)OC_5H_{11}n$;

$R^{10}$ is alkyl containing 1 to 5 carbon atoms, such as methyl, ethyl, propyl or pentyl, or phenyl; and $R^{11}$ is hydrogen, haloalkyl containing 1 to 3 carbon atoms, such as $CCl_3$, $CF_3$ and $C_3H_4Br$; $CH_2OCH_3$, or $C_2H_4COOH$.

The letter n, such as in:

$$\overset{O}{\overset{\|}{C}}NH\text{-}C_6H_5\text{-}OC_5H_{11}n,$$

means normal. Alkyl and phenyl, as described, include alkyl and phenyl that are unsubstituted alkyl and phenyl, as well as alkyl and phenyl that contain substituent groups that do not adversely effect the desired image. An example of a suitable substituent group is alkyl containing 1 to 3 carbon atoms, such as methyl or ethyl.

Examples of useful resorcinol dye-forming couplers are described in, for example, *Research Disclosure,* September 1978, Item 17326. Especially useful resorcinol dye-forming couplers include 2′,6′-dihydroxyacetanilide and 2′,6′-dihydroxytrifluoroacetanilide. Another useful resorcinol dye-forming coupler is 2′,6′-dihydroxy-2,5-dimethylbenzanilide (2′,6′-dihydroxyacetanilide has also been known as 2,6-dihydroxyacetanilide and 2′,6′-dihydroxy2,5-dimethylbenzanilide has also been known as 2,6-dihydroxy-2′,5′-dimethylbenzanilide).

Resorcinol dye-forming couplers as described are prepared by procedures known in the chemical art. For example, resorcinol couplers as described are prepared from amino resorcinols or dihydroxybenzoic acids.

The dye-forming coupler is useful in a range of concentrations in the described recording layer. Typically, the recording layer contains a concentration of dye-forming coupler that is within the range of about 0.1 to about 1.0 mole of the dye-forming coupler per mole of total silver in the recording layer. An especially useful concentration of dye-forming coupler is within the range of about 0.25 to about 0.75 mole of dye-forming coupler per mole of total silver in the recording layer.

Selection of an optimum concentration of dye-forming coupler will depend upon such factors as the particular coupler, the desired image, processing conditions, other components in the recording layer and the like.

Useful silver salts of 1,2,4-mercaptotriazole derivatives according to the invention include those represented by the formula:

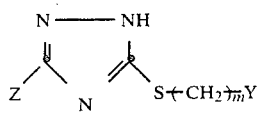

(I′)

wherein Y is aryl containing 6 to 12 carbon atoms, such as phenyl, naphthyl and para-chlorophenyl; m is 0 to 2; and Z is hydrogen, hydroxyl or amine ($-NH_2$). Especially useful organic silver salt oxidizing agents within this class are those silver salts of the described 1,2,4-mercaptotriazole derivatives wherein Y is phenyl, naphthyl or para-chlorophenyl and Z is amine ($-NH_2$). An example of such a compound is the silver salt of 3-amino-5-benzylthio-1,2,4-triazole (referred to herein as ABT). Such organic silver salt oxidizing agents are described in, for instance, U.S. Pat. No. 4,123,274 and U.S. Pat. No. 4,128,557.

Combinations of organic silver salt oxidizing agents are useful. An example of a combination of organic silver salt oxidizing agents is the combination of the silver salts of ABT with the silver salt of 1-methyl-4-imidazoline-2-thione. Other combinations include the combination of the silver salt of ABT with silver salts of nitrogen acids described in *Research Disclosure,* Volume 150, October, 1976, Item 15026.

Selection of an optimum organic silver salt oxidizing agent or combination of organic silver salt oxidizing agents will depend upon the described factors, such as the desired image, the particular reducing agent, the particular dye-forming coupler, processing conditions, the particular binder and the like. An especially useful organic silver salt oxidizing agent is the silver salt of ABT.

The organic silver salt oxidizing agent or combination of organic silver salt oxidizing agents are useful in a range of concentrations in the described recording layer. Selection of an optimum concentration of organic silver salt oxidizing agent or combination of organic silver salt oxidizing agents will depend upon the described factors, such as the desired image, the particular reducing agent, the particular dye-forming coupler, processing conditions and the like. A typically useful concentration of organic silver salt oxidizing agent or combination of organic silver salt oxidizing agents is within the range of about 0.1 mole to about 2.0 moles of silver salt oxidizing agent per mole of reducing agent in the recording layer. For example, when the organic silver salt oxidizing agent is the silver salt of ABT, a typically useful concentration of the organic silver salt oxidizing agent is within the range of about 0.1 to about 2.0 moles of organic silver salt oxidizing agent per mole of reducing agent in the recording layer.

Preparation of the described organic silver salt oxidizing agent is typically not carried out in situ, that is, not in combination with other components of the recording layer as described. Rather, the preparation of the oxidizing agent is typically carried out ex situ, that is separate from other components of the recording layer. In most instances, the preparation of the organic silver salt oxidizing agent will be separate from the other components based on the ease of control of preparation and storage capability.

The term "salt" as used herein, such as in organic silver salt, is intended to include any type of bonding or complexing mechanism which enables the resulting material to produce desired imaging properties in the described recording layer. In some instances, the exact bonding of the described silver salt with the organic compound is not fully understood. Accordingly, the term "salt" is intended to include what are known in the chemical art as "complexes". The term "salt" is intended to include, for example, neutral complexes and non-neutral complexes. The term is also intended to include compounds which contain any form of bonding which enables the desired image-forming combination to provide the desired image.

Many reducing agents which, in their oxidized form, form a dye with the described dye-forming coupler are useful in the recording element according to the invention. The reducing agent is typically an organic silver halide color developing agent. Combinations of reducing agents are useful. It is important that the reducing agent produces an oxidized form upon reaction with the organic silver salt oxidizing agent which reacts at processing temperature with the described dye-forming coupler to produce a desired dye. Especially useful reducing agents are primary aromatic amines including, for example, paraphenylenediamines. Examples of useful reducing agents which are primary aromatic amines include 4-amino-N,N-dimethylaniline; 4-amino-N,N-diethylaniline; 4-amino-3-methyl-N,N-diethylaniline (also known as N,N-diethyl-3-methyl-paraphenylenediamine); 4-amino-N-ethyl-N-β-hydroxyethylaniline; 4-amino-3-methyl-N-ethyl-N-β-hydroxyethylaniline; 4-amino-3-methoxy-N-ethyl-N-β-hydroxyethylaniline; 4-amino-N-butyl-N-gammasulfobutylaniline; 4-amino-3-methyl-N-ethyl-N-β-sulfoethylaniline; 4amino-3-β-(methanesulfonamido)ethyl-N,N-diethylaniline, 4-amino-3-methyl-N-ethyl-N-β-(methanesulfonamido)ethylaniline; and 4-amino-3-methyl-N-ethyl-N-β-methoxyethylaniline.

The term "reducing agent" as used herein includes compounds which are reducing agent precursors in the described recording layer. That is, those compounds are included which are not reducing agents in the recording layer until a condition occurs such as heating of the recording layer.

An especially useful reducing agent is one that consists essentially of a paraphenylenediamine silver halide developing agent that exhibits an E $\frac{1}{2}$ value in aqueous solution at pH 10 within the range of −25 to +175 millivolts versus SCE. The term "E $\frac{1}{2}$ value" herein means half wave potential. The term "SCE" herein means saturated calomel electrode. These values are determined by analytical procedures known in the photographic art and described in, for example, the text "The Theory of the Photographic Process", 4th Edition, Mees and James, 1977, pages 318–319.

The described reducing agent is useful in a range of concentrations in the described element according to the invention. Selection of an optimum concentration of reducing agent or combination of reducing agents will depend upon the described factors including the desired image, the particular organic silver salt oxidizing agent, the particular dye-forming coupler, processing conditions and the like. A typically useful concentration of reducing agent or combination of reducing agents is within the range of about 0.1 to about 5.0 moles of reducing agent per mole of organic silver salt in the recording layer as described. An especially useful concentration of reducing agent is within the range of about 0.2 to about 2 moles of reducing agent per mole of organic silver salt in the recording layer.

The tone of the combined silver image and dye image produced according to the invention will vary, depending upon such factors as the silver morphology of the developed silver image, the covering power of the silver materials, the particular dye-forming coupler, the particular developing agent, processing conditions and the like. In recording layers that produce a brown silver image, the hue of the dye image produced is preferably complimentary to the hue of the silver image. An image hue of the combined dye image and silver image is preferably "neutral".

The term "neutral" herein includes hues which occasionally are described in the photographic art as blue-black, gray, purple-black, black and the like. Whether or not a given image is "neutral" can be readily determined by visual inspection with the unaided eye.

Procedures for determining whether or not an image is "neutral" are known in the photographic art, such as described in *Research Disclosure,* September 1978, Item 17326.

Silica is generally useful in an image recording layer of a recording element according to the invention. Silica in the recording layer helps produce increased density in a developed image upon imagewise exposure and heating the recording layer. A variety of forms of silica are useful. However, colloidal silica is especially useful because it has a large surface area. The optimum concentration of silica in the recording layer will depend upon such factors as the desired image, other components in the recording layer, processing conditions, layer thickness and the like. The concentration of silica is within the range of about 1 to about 1,000 milligrams per 500 square centimeters of support. The silica is a disadvantage in preparation of a high resolution transparency, because the silica may reduce resolution of the developed image and cause undesired light scattering.

The average particle size and particle size range of silica in the recording layer will vary. The optimum average particle size and particle size range of silica will depend upon the described factors regarding silica concentration. Typically, the average particle size and particle size range of colloidal silica are most useful. Colloidal silica that is useful includes such commercially available colloidal silica products as "Cab-O-Sil", a trademark of and available from the Cabot Corporation, U.S.A. and "Aerosil", a trademark of and available from DEGUSSA, West Germany. It is important that the average particle size and particle size range of the silica or any other equivalent particles not adversely affect the desired properties of the electrically activated recording element of the invention or the desired image produced upon imagewise exposure and heating of the recording layer. For instance, the silica selected should not decrease sensitivity of the recording layer or produce undesired fogging of the developed image.

The mechanism and properties which cause colloidal silica to produce increased density in a recording layer according to the invention is not fully understood. It is believed that the large surface area of colloidal silica contributes to the desired results. In any case, an especially useful embodiment of the invention, as described, is one containing colloidal silica in the recording layer of a charge-sensitive recording paper according to the invention.

The described element according to the invention comprises various colloids and polymers alone or in combination as vehicles and binding agents. These vehicles and binding agents can be in various layers of the element, especially in the recording layer. Suitable materials are hydrophobic or hydrophilic. It is necessary, however, that the vehicle or binder in the element not adversely affect the charge sensitivity or ohmic resistivity of the element of the invention. It is also necessary that the vehicle or binder be compatible with the EAC layer according to the invention. Accordingly, the selection of an optimum colloid or polymer, or combination of colloids or polymers, will depend upon such factors as the desired charge sensitivity, desired ohmic resistivity, particular polymer, desired image, particular processing conditions, particular EAC layer and the like. Useful colloids and polymers are transparent or translucent and include both naturally occurring substances such as proteins, for example, gelatin, gelatin derivatives, cellulose derivatives, polysaccharides, such as dextran, gum arabic and the like. Synthetic polymers, however, are preferred due to their desired charge sensitivity properties and ohmic resistivity properties. Useful polymeric materials for this purpose include polyvinyl compounds, such as poly(vinyl pyrrolidone), acrylamide polymers and dispersed vinyl compounds such as in latex form. Effective polymers include water insoluble polymers of alkylacrylates and methacrylates containing minor amounts of acrylic acid, sulfoalkylacrylates or methacrylates and those which have cross-linking sites which facilitate hardening or curing. Especially useful polymers are high molecular weight materials and resins which are compatible with the described components of the element according to the invention. These include, for example, poly(vinyl butyral), cellulose acetate butyrate, poly(methyl methacrylate), poly(vinyl pyrrolidone), ethyl cellulose, polystyrene, poly(vinyl chloride), poly(isobutylene), butadiene-styrene copolymers, vinyl chloride-vinyl acetate copolymers, copolymers of vinyl acetate, vinyl chloride and maleic acid and poly(vinyl alcohol). Combinations of colloids and polymers are also useful depending upon the described factors. Highly preferred binders include polyacrylamide, as well as copolymers of acrylamide and other vinyl addition monomers such as copolymers of acrylamide and vinyl imidazole or copolymers of acrylamide and N-methyl acrylamide.

An overcoat layer is useful on the recording layer according to the invention. It is important that the overcoat layer not adversely affect the desired charge sensitivity and ohmic resistivity properties of the element according to the invention. Such an overcoat layer reduces fingerprinting and abrasion marks before and after exposure and processing. The overcoat layer is one or more of the described polymers which are useful as binders. These materials must be compatible with other components of the described element according to the invention and must be able to tolerate the processing temperatures which are useful for developing the described images.

While it is in most cases unnecessary and undesirable, a photosensitive component can be present in the electrically activated recording layer, as described, if desired. The photosensitive component is any photosensitive metal salt or complex which produces developable nuclei upon charge exposure according to the invention. If a photosensitive component is present in the recording layer, an especially useful photosensitive metal salt is photosensitive silver halide due to its desired properties in forming developable nuclei upon charge exposure. A typical concentration of photosensitive metal salt is within the range of about 0.0001 to about 10.0 moles of photosensitive metal salt per mole of organic silver salt in the described element according to the invention. For example, a typical concentration range of photosensitive silver halide is within the range of about 0.001 to about 2.0 moles of silver halide per mole of organic silver salt in the recording element. A preferred photosensitive silver halide is silver chloride, silver bromide, silver bromoiodide or mixtures thereof. For purposes of the invention, silver iodide is also considered to be a photosensitive silver halide. Very fine grain photographic silver halide is useful, although a range of grain size from fine grain to coarse grain photographic silver halide can be included in the recording layer, if desired. The photographic silver halide can be prepared by any of the procedures known in the photographic art. Such procedures and forms of photographic silver halide are described in, for example, *Research Disclosure,* December 1978, Item No. 17643. The photographic silver halide can be washed or unwashed, can be chemically sensitized by means of chemical sensitization procedures known in the art, can be protected against the production of fog and stabilized against loss of sensitivity during keeping, as described in the above *Research Disclosure* publication.

If a photosensitive component is present in the described electrically activated recording layer, the described image-forming combination enables the concentration of the photosensitive component to be lower than normally would be expected in a photosensitive element. This lower concentration is enabled by the amplification affect of the image-forming combination, as described, as well as the formation of developable nuclei according to the invention in addition to the dye enhancement of the silver image formed. In some instances the concentration of photosensitive metal salt can be sufficiently low that after imagewise exposure and development of the photosensitive metal salt alone, in the absence of other of the described component, the developed image is not visible to the unaided eye.

The elements according to the invention contain, if desired, addenda which aid in producing a desired image. These addenda include, for example, development modifiers that function as speed-increasing compounds, hardeners, plasticizers and lubricants, coating aids, brighteners, spectral sensitizing dyes, absorbing and filter dyes. These addenda are described in, for example, *Research Disclosure,* December 1978, Item 17643.

While it is in many cases unnecessary and undesirable, a post-processing stabilizer or stabilizer precursor to increase post-processing stability of the developed image is included, if desired, in the described recording layer. In many cases the recording layer following processing is sufficiently stable to avoid the need for incorporation of a stabilizer or stabilizer precursor in the recording layer. However, in the case of recording materials which contain photosensitive silver halide, it is desirable to include such a stabilizer or post-processing stabilizer precursor to provide increased post-processing stability. Many stabilizer or stabilizer precursors are useful in the elements according to the invention. These stabilizers or stabilizer precursors are useful alone or in combination, if desired. Typically useful stabilizers or stabilizer precursors include, for instance, photolytically active polybrominated organic compounds. Thioethers or blocked azolinethione stabilizer precursors or other organic thione stabilizer precursors known to be useful in photothermographic materials are useful, if desired.

When a stabilizer or stabilizer precursor is present in the recording layer of an element according to the invention, a range of concentrations of stabilizer or stabilizer precursor is useful. The optimum concentration of stabilizer or stabilizer precursor will depend upon such factors as the particular element, processing conditions, particular stabilizer or stabilizer precursor, desired stability of the developed image and the like. A useful concentration of stabilizer or stabilizer precursor is within the range of about 1 to about 10 moles of stabilizer or stabilizer precursor per mole of photosensitive component in the element according to the invention.

It is often advantageous to include a heat sensitive base-release agent or base precursor in the recording element according to the invention to produce improved and more effective image development. A base-release agent or base precursor herein includes compounds, which upon heating in the recording layer, produce a more effective reaction between the described components of the image-forming combination and in addition produce improved reaction between the oxidized form of the described reducing agent and the dye-forming coupler. Examples of useful heat sensitive base-release agents or base precursors are aminimide base-release agents, such as described in *Research Disclosure,* Volume 157, May 1977, Items 15733, 15732, 15776 and 15734; guanidinium compounds, such as guanidinium trichloroacetate; and other compounds which are known in the photothermographic art to release a base moiety upon heating, but do not adversely affect the desired properties of the recording element. Combinations of heat sensitive base-release agents are useful, if desired.

A heat sensitive base-release agent or base precursor, or combinations of such compounds, is useful in a range of concentrations in the described elements according to the invention. The optimum concentration of heat sensitive base-release agent or base precursor will depend upon such factors as the desired image, particular dye-forming coupler, particular reducing agent, other components of the imaging element, processing conditions and the like. A useful concentration of described base-release agent is typically within the range of about 0.25 to 2.5 moles of base-release agent or base precursor per mole of reducing agent in the recording layer according to the invention.

The electrically activatable recording element according to the invention advantageously comprises a variety of supports. The term "electrically conductive support" herein includes (a) supports that are electrically conductive without the need for separate addenda in the support or on the support to produce the desired degree of electrical conductivity and (b) supports that comprise addenda or separate electrically conductive layers that enable the desired degree of electrical conductivity. Typical supports include cellulose ester, poly(vinyl acetal), poly(ethylene terephthalate), polycarbonate and polyester film supports and related films and resinous materials. Other supports are useful, such as glass, paper, metal and the like which can withstand the processing temperatures described and do not adversely affect the charge-sensitive properties and ohmic resistivity which is desired. A flexible support is most useful. It is necessary that the various layers according to the invention adhere to the support. A subbing layer to aide adhesion is preferred on the support. Such a subbing layer is, for example, a poly(methyl acrylate-co-vinylidene chloride-co-itaconic acid) subbing layer.

The recording element according to the invention generally includes an electrically conductive layer positioned between the support and the described polymeric EAC layer. This is illustrated by electrically conductive layer 55 in FIG. 5. The electrically conductive layers, as described, such as layers 62 and 55 in FIG. 5, comprise a variety of electrically conducting compounds which do not adversely effect the charge sensitivity and ohmic resistivity properties of an element according to the invention. Examples of useful electrically conductive layers include layers comprising an electrically conductive chromium composition, such as cermet, and nickel.

Figure 5:
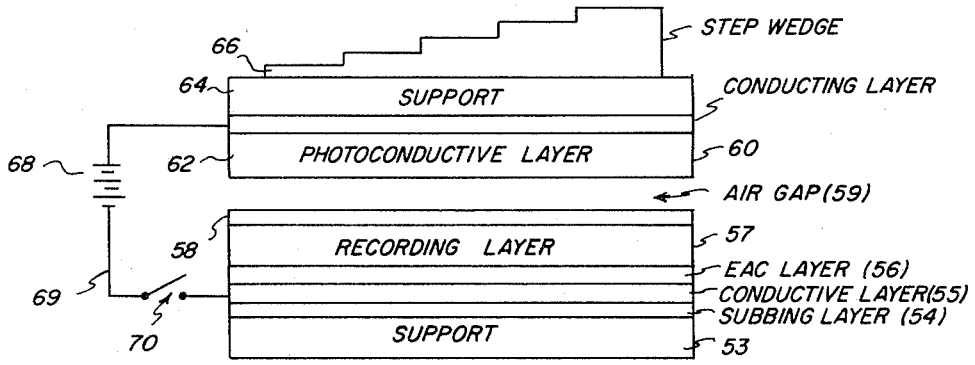
FIG. 5 illustrates schematically an image recording material that is especially useful according to the invention.

In some embodiments, the photoconductive layer is a self-supporting layer, such as a photoconductor in a suitable binder. In such embodiments an electrically conductive layer, such as an electrically conductive nickel or chromium composition layer, is coated on the photoconductive layer. This is illustrated in, for instance, FIG. 3 in the drawings in which electrically conductive layer 28 is on photoconductive layer 30 which is self-supporting. Alternatively, the photoconductive layer is coated on an electrically conductive support, such as illustrated in FIG. 5 of the drawings.

The described layers according to the invention are coated by coating procedures known in the photographic art, including vacuum deposition, sintering, dip coating, airknife coating, curtain coating or extrusion coating, using hoppers known in the photographic art. If desired, two or more layers are coated simultaneously.

The various components of the charge-sensitive materials according to the invention are prepared for coating by mixing the components with suitable solutions or mixtures including suitable organic solvents depending on the particular charge-sensitive material and the components. The components are added by means of procedures known in the photographic art.

Useful charge-sensitive elements according to the invention comprise an electrically conductive support having thereon an electrically activatable recording layer which has a thickness within the range of about 1 to about 30 microns, typically within the range of about 2 to about 15 microns. The optimum layer thickness of each of the layers of an element according to the invention will depend upon such factors as the particular ohmic resistivity desired, charge sensitivity, particular components of the layers, desired image and the like.

The EAC layer, such as layer 56 illustrated in FIG. 5, has a thickness within the range of about 0.02 to about 10 microns, such as within the range of about 0.05 to about 5 microns. The optimum layer thickness of the polymeric electrically conductive EAC layer of an element according to the invention will depend upon such factors as the particular ohmic resistivity desired, charge sensitivity, desired image, the electrically activated recording layer and the like.

A "melt-forming compound" is useful in the recording layer according to the invention to produce an improved developed image. A "melt-forming compound" is especially useful with recording materials containing silver salts of nitrogen acids. The term "melt-forming compound" herein is intended to mean a compound which upon heating to the described processing temperature produces an improved reaction medium, typically a molten medium, wherein the described image-forming combination produces a desired image upon development. The exact nature of the reaction medium at processing temperature described is not fully understood. It is believed that at the reaction temperature, a melt occurs which permits the reaction components to better interact. If desired, a melt-forming compound is included with other components of the recording layer prior to coating on the support. Examples of useful melt-forming compounds include succinimide, dimethyl urea, sulfamide and acetamide.

The optimum concentration of the described components of the element according to the invention will depend upon a variety of factors. An especially useful recording element according to the invention comprises about 1 to about 5 moles of the dye-forming coupler for each 1 to 5 moles of the reducing agent and about 3 to about 20 moles of the organic silver salt oxidizing agent.

The described organic silver salt oxidizing agent contains a range of ratios of the organic moiety to the silver ion. The optimum ratio of the organic moiety to silver ion in the organic silver salt oxidizing agent will depend upon such factors as the particular organic moiety, the particular concentration of silver ion desired, processing conditions, the particular dye-forming coupler and the like. The molar ratio of organic moiety to silver as silver ion in the salt is typically within the range of about 0.5:1 to about 3:1.

The image recording layer of the invention has a range of pAg. The pAg is measured by means of conventional calomel and silver-silver chloride electrodes, connected to a commercial digital pH meter. The pAg in a dispersion containing the described components for the recording layer is advantageously within the range of about 2.5 to about 7.5. The optimum pAg will depend upon the described factors, such as the desired image, processing conditions and the like.

A recording material containing the described organic silver salt oxidizing agent typically has a pH that is within the range of about 1.5 to about 7.0. An especially useful pH for the described recording layer is within the range of about 2.0 to about 6.0.

The desired resistivity characteristics of a recording material according to the invention is obtained by separately measuring the current-voltage characteristic of each sample coating at room temperature by means of a mercury contact sample holder to make a mercury contact to the surface of the coating. To eliminate the possibility that a micro thickness surface air gap might affect the measured resistivity, exposures are made with evaporated metal (typically, bismuth or aluminum) electrode on the surface of a charge sensitive coating to be tested. The resistivity is measured at various ambient temperatures. The data are measured at a voltage of, for example, 20 volts or $4\times10^4$ volts per centimeter, which is within the ohmic response range of the layer to be tested. The resistivity of the charge-sensitive layer will vary widely with temperature. The dielectric strength of the layer will also vary with temperature.

An especially useful embodiment of the invention having the desired characteristics comprises a charge-sensitive recording element, preferably having an ohmic resistivity of at least about $10^4$ ohm-cm, comprising, in sequence: (a) a first electrical conducting layer, (b) a photoconductive layer, (c) an electrically activatable recording layer separated from (b) by an air gap of up to about 20 microns and comprising, in reactive association: (A) a dye-forming coupler consisting essentially of 2′,6′-dihydroxytrifluoroacetanilide, (B) an image-forming combination consisting essentially of (i) an organic silver salt oxidizing agent consisting essentially of a silver salt of 3-amino-5-benzylthio-1,2,4-triazole, with (ii) a reducing agent consisting essentially of 4-amino-2-methoxy-N,N,5-trimethylaniline sulfate, and (C) a polyacrylamide binder, (d) an EAC layer consisting essentially of a poly(alkyl acrylate-co-vinylidene chloride) on (e) a second electrical conducting layer, such as a cermet layer, on (f) a support, such as a support containing a subbing layer comprising poly(methyl acrylate-co-vinylidene chloride-co-itaconic acid).

A variety of energy sources are useful for imagewise exposure of a recording element according to the invention. Selection of an optimum energy source for imagewise exposure will depend upon the described factors, such as the sensitivity of the photoconductor layer, the particular image recording combination in the electrically activatable recording layer, desired image and the like. Useful energy sources for imagewise exposure include, for example, visible light, X-rays, lasers, electron beams, ultraviolet radiation, infrared radiation and gamma rays.

An especially useful process embodiment of the invention is a dry electrically activated recording process for producing a dye enhanced silver image in a charge-sensitive recording element, preferably having an ohmic resistivity of at least about $10^4$ ohm-cm, comprising, in sequence, a support having thereon (a) a first electrically conductive layer, (b) an organic photoconductive layer, (c) an electrically activatable recording layer separated from (b) by an air gap of up to 20 microns and comprising (A) a dye-forming coupler consisting essentially of a compound selected from the group consisting of 2,6-dihydroxyacetanilide and 2′,6′-dihydroxytrifluoroacetanilide and combinations thereof, (B) an image-forming combination comprising (i) an organic silver salt oxidizing agent consisting essentially of a silver salt of 3-amino-5-benzylthio-1,2,4-triazole, with (ii) a reducing agent consisting essentially of 4-amino-2-methoxy-N,N,5-trimethylanilinesulfate, and (iii) a polyacrylamide binder, (d) a polymeric EAC layer according to the invention and (e) a second electrically conductive layer; said process comprising the steps: (I) imagewise altering the conductivity of the photoconductive layer in accord with an image (X') to be recorded while simultaneously (II) applying across the photoconductive layer and recording layer an electrical potential of a magnitude and for a sufficient time to produce a developable latent image in the recording layer corresponding to the image (X'); and then (III) heating the recording layer substantially uniformly at a temperature and for a time sufficient to produce a dye enhanced silver image corresponding to image (X') in the recording layer.

An imagewise current flow is produced through the described electrically activated recording layer. Although a particular technique to produce an imagewise current flow has been described for use in a variety of recording apparatus, the especially useful techniques are those which include use of a photoconductive layer as an image to current converter. If desired, the imagewise current flow is provided by contacting the recording element with a suitable electrostatically charged means such as an electrostatically charged stencil or scanning the recording element with a beam of electrons.

Heating the recording element after latent image formation is carried out by techniques and by means known in the photothermographic art. For example, the heating is carried out by passing the imagewise exposed recording element over a heated platen or through heated rolls, by heating the element by means of microwaves, by means of dielectric heating or by means of heated air. A visible image is produced in the described exposed material within a short time, that is within about 1 to about 90 seconds, by the described uniform heating step. An image having a maximum transmission density of at least 1.0 and typically at least 2.2 can be produced according to the invention. For example, the recording element is uniformly heated to a temperature within the range of about 100° C. to about 200° C. until a desired image is developed, typically within about 1 to about 90 seconds. The imagewise exposed material according to the invention is preferably heated to a temperature within the range of about 120° C. to about 180° C. The optimum temperature and time for processing will depend upon such factors as the desired image, the particular recording element, heating means and the like.

The described electrically activated recording process is useful for producing multiple copies. According to this embodiment of the invention, multiple copies are prepared by a dry electrically activated recording process for producing a dye image and silver image, preferably a dye enhanced silver image, in an electrically activatable recording element comprising the steps of: (I) imagewise altering the conductivity of a photoconductive layer in accord with an image that is to be recorded; (II) positioning the imagewise altered photoconductive layer from (I) adjacent an electrically activatable recording layer of the recording element, (III) applying an electrical potential across the photoconductor layer and recording layer of a magnitude and for a time sufficient to produce in the areas of the recording layer corresponding to the imagewise altered portions of the photoconductor layer a charge density within the range of about $10^{-5}$ coulomb/cm$^2$ to about $10^{-8}$ coulomb/cm$^2$, the charge density forming in the areas a developable latent image; then (IV) uniformly heating the recording element at a temperature and for a time sufficient to produce a dye image and silver image, preferably a dye enhanced silver image, in the recording element; followed by (V) positioning the imagewise altered photoconductor layer adjacent a second electrically activatable recording layer, preferably having an ohmic resistivity of at least about $10^4$ ohm-cm, wherein said photoconductor layer is separated from said second recording layer by an air gap of up to 20 microns; (VI) applying an electrical potential across the photoconductor layer and the second recording layer of a magnitude and for a sufficient time to produce in the areas of the image of said photoconductive layer a charge density within the range of about $10^{-5}$ coulomb/cm$^2$ to about $10^{-8}$ coulomb/cm$^2$, the charge density forming a developable latent image; and then (VII) uniformly heating the second recording layer at a temperature and for a time sufficient to produce a developed image in the second recording layer.

While the exact mechanism of image formation upon heating is not fully understood, it is believed that the imagewise exposure to charge provides nuclei in the image areas. Such nuclei apparently increase the reaction rate and act as catalysts for the reaction between the organic silver salt oxidizing agent and the reducing agent. It is believed that the nuclei enable a form of amplification which would not otherwise be possible. The organic silver salt oxidizing agent and reducing agent must be in a location with respect to each other which enables the nuclei formed to provide the desired catalytic effect. The organic silver salt oxidizing agent and reducing agent as well as the dye-forming coupler are in reactive association in the electrically activated recording layer. The term "in reactive association" is intended to mean that the nuclei resulting from the imagewise exposure are in a location with respect to the described components which enables desired catalytic activity, desired processing temperature and capability for a more useful dye image and silver image.

Figure 2:
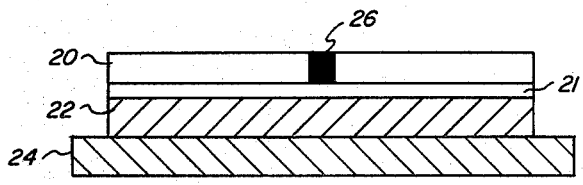

Referring to the drawings, embodiments of the invention are depicted schematically in FIGS. 1 and 2. According to the embodiment illustrated in FIGS. 1 and 2, a charge-sensitive recording layer 10 having a polymeric EAC layer 11 according to the invention is placed upon a grounded electrically conductive backing or support 12. A current is selectively applied to the recording layer 10 by the point of a metal stylus 14 which is raised to a sufficiently high voltage relative to the support 12 by a voltage source 16, and brought into moving contact with the exposed surface of the recording layer 10 containing the described image-forming combination and dye-forming coupler. Upon contacting the recording layer 10 with the stylus 14, a current flow is produced in the areas, such as area 18, of the recording layer contacted by the stylus and a developable latent image forms, i.e. a pattern of nuclei sites, in the pattern desired. The charge density produced by the stylus in the contacted areas of the recording layer need not be sufficient to produce a visible image in the recording layer 10; however, the charge density must be sufficient to produce a latent image in the recording layer in those areas contacted by the stylus. Although a particular technique to produce an imagewise current flow through the recording layer 10 has been described, techniques for producing imagewise current flow generally known in the art of recording may be used and are intended to be encompassed by the description. The area of the recording layer 10 designated as 18 is intended to be illustrative of an area of nuclei sites formed upon contact of the stylus 14 with the recording layer 10. Other techniques for producing a nuclei pattern include, for example, contacting the recording layer 10 with an electrostatically charged stencil or scanning the layer 10 with a beam of electrons in an image pattern.

FIG. 2 illustrates development of the latent image formed in the recording element in FIG. 1 by, for example, moving the element from FIG. 1 into contact with a heated metal platen 24. The heat from platen 24 passes through the support 22 and polymeric EAC layer 21 according to the invention to the layer 20 containing the latent image to cause the desired reaction in the latent image area. The reaction in the latent image area causes development to produce a visible image 26 consisting essentially of a dye image and silver image, preferably a dye enhanced silver image, in the recording layer 20. Upon development the recording element is removed from the platen 24. No processing solutions or baths are required in this heat development step.

Figure 3:
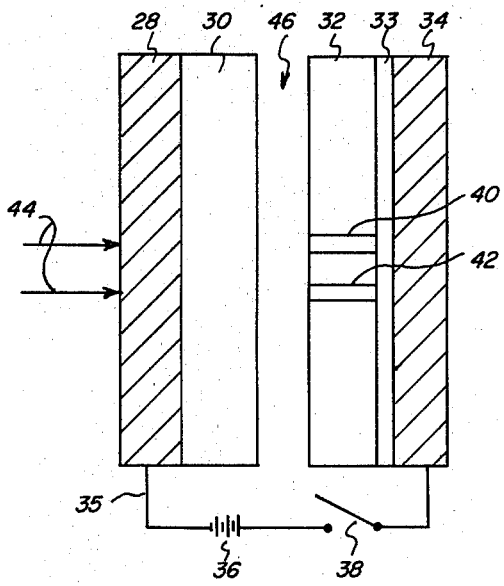
FIGS. 3 and 4 illustrated schematically an electrically activated recording process embodying the described invention.
Figure 4:
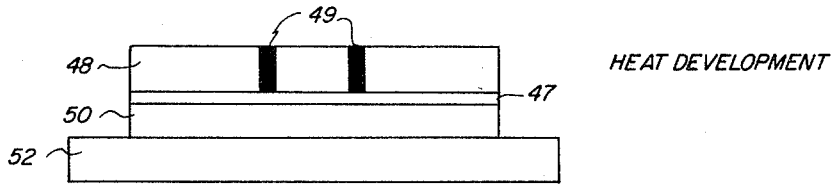

Another illustrative embodiment of the invention is schematically shown in FIGS. 3 and 4. In this embodiment, in FIG. 3, the developable sites 40 and 42, that is the latent image sites, are formed by sandwiching a charge-sensitive recording layer 32 and an image-to-current converter layer 30, preferably a photoconductive layer, between a pair of electrically conductive layers 28 and 34. A polymeric EAC layer 33 according to the invention is present between electrically conductive layer 34 and charge-sensitive recording layer 32. Layers 28 and 34 comprise, if desired, suitable supports for layers 30, 32 and 33 or layers 28 and 34 are on separate suitable supports, not shown, such as film supports. A high potential electrical field, such as at a voltage within the range of about 0.01 to about 6.0 KV, is established across the photoconductive layer 30 and recording layer 32 by connecting the conductive layers 28 and 34 by connecting means 35 containing power source 36. The electric field across the layers is controlled by switch 38. The latent image formation at latent image sites 40 and 42 is caused by imagewise exposing the photoconductive layer 30 through the conductor 28 to exposure means 44, typically actinic radiation, preferably X-ray. The layer 28 and any support for layer 28 must be sufficiently transparent to the energy 44 to enable the energy to pass to a desired degree to photoconductive layer 30. The exposure selectively increases the conductivity of the conductive layer in those regions exposed to actinic radiation. When switch 38 is in a closed condition, thereby establishing an electric field across the layers, an imagewise current flow is produced through the recording layer 32. The current flow occurs in those regions of the recording layer 32 only in position with the exposed portions of the photoconductive layer 30. An air gap 46 of up to 20 microns is provided between layers 30 and 32. The air gap 46 is, for example, 1 to 10 microns. After a sufficient charge density, typically less than 1 millicoulomb per square centimeter, preferably about 1.0 microcoulomb/$cm^2$, has been produced in the current exposed portions of the recording layer 32, switch 38 is opened, thereby disrupting the current flow.

The described technique for application of voltage across the photoconductive and recording layers is illustrative. A variety of techniques known in the recording art are useful and are intended to be included in this description. For example, a grid control corona discharge means, not shown, such as described in U.S. Pat. No. 3,370,212, can be substituted for the voltage source and conducting layer 28.

To develop the dye image and silver image in latent image sites 40 and 42, the recording element containing layers 32, 33 and 34 is moved away from the photoconductive layer. Connecting means 35 is also disconnected. The recording element illustrated in FIG. 4 is then contacted with a heating means, such as a heated platen 52 illustrated in FIG. 4. The heat from the platen 52 passes through the support 50 and polymeric EAC layer 47 to the layer 48 containing a latent image to produce a visible dye image and silver image 49. The heating is preferably carried out substantially uniformly by merely positioning the recording element in heat transfer relationship with the heated platen 52. After the development of the silver image and the dye image, the recording element is removed from the platen.

An especially useful embodiment of the invention is illustrated in FIG. 5 in the drawings. In FIG. 5, the charge-sensitive recording arrangement consists of a support 53 having thereon a polymeric subbing layer 54, such as a poly(alkyl acrylate-co-vinylidene chloride-co-itaconic acid) subbing layer, having thereon an electrically conductive layer 55, typically consisting of a cermet composition, having thereon a polymeric EAC layer 56. The subbing layer 54 helps the conductive layer 55 adhere to the support 53. On the polymeric EAC layer 56 is coated a recording layer 57 containing the image-forming combination and dye-forming coupler. An air gap 59, such as up to 20 microns, is present between overcoat layer 58 on recording layer 57 and a lead monoxide photoconductive layer 60. The layer 60 has a nickel electrically conductive layer 62 which is on a transparent film support 64. Developable nuclei are formed in recording layer 57 by imagewise exposure with a suitable radiation source, such as a tungsten light source or X-ray source, not shown, through step tablet 66. At the time of imagewise exposure with the energy source, a high potential electric field, such as at a voltage within the range of about 0.01 to 6.0 KV, is established across the photoconductive and image-recording layers by connecting the conductive layer 62 and the electrically conductive layer 55 by connecting means 69 through a power source 68. The electric field across the layers is controlled by switch 70. After the necessary charge density is established, switch 70 is opened, thereby disrupting the current flow. Imagewise exposure for about 1 second at about 50 footcandles produces a developable image in recording layer 57. A 0.3 density step wedge is used for imagewise exposure purposes if desired. To develop the resulting latent image, layer 57 is disconnected from connecting means 69 and power source 68 and moved away from the photoconductive layer 60. The recording layer 57 is then heated uniformly by contacting it with a heated metal platen, not shown, until the desired dye image and silver image are produced.

The photoconductive layer, such as the layer 60 in FIG. 5, can include a variety of binders and/or sensitizers known in the electrophotographic art. Useful binders are described in, for example, U.S. Pat. No. 2,361,019 of Gerhart and U.S. Pat. No. 2,258,423 of Rust. Sensitizing compounds useful in the photoconductive layer are described in, for example, U.S. Pat. No. 3,978,335 of Gibbons.

In the embodiments illustrated which use an air gap between the photoconductor and image recording layers, the air gap distances are controlled by methods known in the art, such as by the roughness of the surface of the photoconductor layer, as well as the roughness of the surface of the image recording layer. The air gap need not be uniform. However, best results are often observed with a uniform air gap. The air gap is for example, up to about 20 microns thick. For example, the distance shown in FIG. 3 between photoconductor layer 30 and recording layer 32 is up to 20 microns, as illustrated by air gap 46.

The resistivity of a useful recording layer according to the invention can be effected by air gap effects. The number of variables affecting the resistance of the recording layer can affect the choice of an optimum recording material and imaging means. The resistivity values as described herein for particular recording materials are values measured under optimum temperature conditions during exposure.

If desired, the recording element and imaging means according to the invention are readily modified to provide a continuous image recording operation. This is carried out by means of desired control circuitry and continuous transport apparatus, not shown.

The following examples are included for a further understanding of the invention.

EXAMPLE 1

This is a comparative example.

This illustrates a negative-working electrically activatable recording element and process for producing a dye image and silver image.

The element and layers for this example are similar to those described in FIG. 5, with the exception that the layer 56 did not consist of a polymeric EAC layer according to the invention. Layer 56 in this example consisted of poly(methyl acrylate-co-vinylidene chloride-co-itaconic acid).

The following composition (A) was coated on an electrically conductive support. This support consisted of a poly(ethylene terephthalate) film support containing a poly(methyl acrylate-co-vinylidene chloride-co-itaconic acid) subbing (layer 54) layer having thereon a cermet conducting layer.

| Composition (A): | |
|---|---|
| silver 3-amino-5-benzylthio-1,2,4-triazole (1.5:1 ligand to silver ion ratio (dispersed in 1 percent gelatin) (organic silver salt oxidizing agent) | 16.0 ml |
| methyl mercaptotriazole (1% solution in ethanol) (antifoggant) | 0.6 ml |
| 4-phenyl-3-imino-5-thiourazole (1% solution in ethanol) (development accelerator) | 0.6 ml |
| surfactant (Surfactant 10G which is a paraisononylphenoxy-glycidol available from the Olin Corporation, U.S.A.) (10% solution in water) | 0.2 ml |
| 4-amino-methoxy-N,N,5-trimethyl aniline sulfate (reducing agent) | 75 mg (dissolved in 1 ml of water) |
| 2',6'-dihydroxytrifluoroacetanilide (dye-forming coupler) | 128 mg (dissolved in 1 ml of water) |
| poly(acrylamide-1-vinylimidazole) (90:10 ratio) (5.6 percent by weight solution in water) (binder) | 1.0 ml |

The composition after mixing was coated at a 12 mil wet coating thickness to produce a recording layer (57 in FIG. 5) containing 100 to 120 milligrams of silver per 929 $cm^2$ of support.

The layer 60 consisted of a 17 micron thick coating of a composite type organic photoconductor consisting essentially of an aggregate organic photoconductor as described in U.S. Pat. No. 3,615,414 as the photoconductive compound. The photoconductor was coated on conducting layer 62 consisting of copper iodide on a poly(ethylene terephthalate) film support 64 shown in FIG. 5. An air gap of up to 20 microns separated the photoconductive layer 60 from recording layer 57. Visible light exposure imagewise was made with simultaneous application of a voltage of positive 4,000 volts to the resulting sandwich shown in FIG. 5. The intensity and duration of light exposure were sufficient to produce a developable latent image in the recording layer 57. A charge exposure of 2.4 microcoulombs/$cm^2$ was used for forming a latent image in the recording layer 57. This level of charge exposure was necessary to provide a developed image density of 1.0.

The photoconductive layer and the recording layer were separated after imagewise exposure and the recording layer was uniformly heated for 10 seconds at 180° C. This produced a silver image and dye image in the exposed areas of the recording layer. A 1.0 transmission density image was observed in the area exposed to charge.

EXAMPLE 2

This is a comparative example.

The element and layers for this example are similar to those described in FIG. 5, with the exception that the layer 56 did not consist of a polymeric EAC layer according to the invention.

A subbed poly(ethylene terephthalate) film support was coated with a layer of cermet. The layer of cermet was then coated with a layer consisting of poly(methyl acrylate-co-vinylidene chloride-co-itaconic acid) (15:83:02 ratio). This polymer was coated on the cermet layer by means of a solution of the polymer in methyl ethyl ketone (also known as MEK). The resulting layer was permitted to dry and then coated with the following composition:

| | |
|---|---|
| silver 3-amino-5-benzylthio-1,2,4-triazole (1.5:1 ligand to silver ion ratio) (dispersed in a solvent consisting of water and ethanol) (organic silver salt oxidizing agent) | 16 ml |
| methylmercaptotriazole (0.5% by weight by weight solution in ethanol) | 0.6 ml |
| poly(acrylamide-co-1-vinylimidazole) (90:10 ratio) (5.6% by weight solution in water) (binder) | 0.8 ml |
| 4-amino-methoxy-N,N,5-trimethyl aniline sulfate (75 mg dissolved in 1 ml of water) (developing agent) | 1.0 ml |
| surfactant (Surfactant 10G which is a paraisononylphenoxypoly- | 0.2 ml |

-continued

| | |
|---|---|
| glycidol and a trademark of the Olin Corporation, U.S.A.) (10 percent by weight in water) | |
| 2,6-dihydroxytrifluoroacetanilide (128 mg dissolved in 1 ml of water) (coupler) | 1.0 ml |
| 4-phenyl-3-imino-5-thiourazole (0.5% by weight solution in ethanol) | 0.6 ml |

The composition was coated at a 12 mil wet coating thickness. The resulting coating contained 11 to 13 mg of silver per 100 square centimeters of support.

The resulting element was imagewise exposed by means of a grid controlled corona exposing means, such as described in U.S. Pat. No. 3,370,212. The grid potential of the exposing means was at +1000 volts and the charge exposure was varied between 100 microcoulombs/cm$^2$ and 1.0 microcoulombs/cm$^2$. After the element was imagewise exposed as described to produce a latent image, the exposed element was removed from the exposing means and uniformly heated for 10 seconds at 180° C. A dye image and silver image were developed to produce a 1.0 maximum transmission density and a minimum density of 0.20 at a charge exposure of 2.4 microcoulombs/cm$^2$.

EXAMPLE 3

This is a comparative example.

An electrically activated recording element was prepared as described in Example 2 with the exception that the layer 56 was omitted. The element was imagewise exposed and processed as described in Example 2.

A charge exposure of 100 microcoulombs/cm$^2$ was necessary to obtain a maximum transmission image density of 0.15.

EXAMPLE 4

This is a comparative example.

An electrically activated recording element was prepared as described in Example 2 with the exception that the layer 56 described in Example 2 was replaced with a polycarbonate layer (LEXAN 145, which is a trademark of General Electric Co., U.S.A.). The element was imagewise exposed and processed as described in Example 2.

A charge exposure of 10 microcoulombs/cm$^2$ was necessary to produce a maximum transmission image density of 0.15.

EXAMPLE 5

This is a comparative example.

An electrically activated recording element was prepared as described in Example 2 with the exception that the layer 56 described in Example 2 was replaced with a poly(vinyl butyral) layer (BUTVAR B-76, a trade name of the Monsanto Co., U.S.A.). The element was imagewise exposed and processed as described in Example 2.

A charge exposure of 10 microcoulombs/cm$^2$ was necessary to obtain a maximum transmission image density os 0.15.

EXAMPLE 6

This is a comparative example.

An electrically activated recording element was prepared as described in Example 2 with the exception that the layer 56 described in Example 2 was replaced with a poly(methyl methacrylate) layer. The element was imagewise exposed and processed as described in Example 2.

A charge exposure of 10 microcoulombs/cm$^2$ was necessary to obtain a maximum transmission image density of 0.15.

EXAMPLE 7

This is a comparative example.

An electrically activated recording element was prepared as described in Example 2 with the exception that the layer 56 described in Example 2 was replaced with a poly(styrene) layer (STYRON, which is a trade name of Dow Chemical Co., U.S.A.). The element was imagewise exposed and processes as described in Example 2.

A charge exposure of 10 microcoulombs/cm$^2$ was necessary to obtain a visible image, that is an image having a maximum transmission density of 0.05.

EXAMPLE 8

This is a comparative example.

An electrically activated recording element was prepared as described in Example 2 with the exception that the layer 56 described in Example 2 was replaced with a poly(chloromethyl styrene) layer. The element was imagewise exposed and processed as described in Example 2.

A charge exposure of 10 microcoulombs/cm$^2$ was necessary to obtain a visible image, that is an image having a maximum transmission density of 0.05.

EXAMPLE 9

This is a comparative example.

An electrically activated recording element was prepared as described in Example 2 with the exception that the layer 56 described in Example 2 was replaced with a poly(vinyl chloride) layer. The element was imagewise exposed and processed as described in Example 2.

A charge exposure of 10 microcoulombs/cm$^2$ was necessary to obtain a visible image, that is an image having a maximum transmission density of 0.05.

EXAMPLE 10

This is a comparative example.

This illustrates use of a copolymer of N-isopropylacrylamide and vinylidene chloride as an EAC layer.

An electrically activated recording element was prepared as described in Example 1 with the exception that the layer 56 (EAC layer) consisted of a poly(N-isopropylacrylamide-co-vinylidene chloride). The element was imagewise exposed and thermally processed as described in Example 1 to produce an image having a 0.1 density for a charge exposure of 1.5 microcoulombs/cm$^2$.

EXAMPLE 11

This is a comparative example.

This illustrates use of a copolymer of N-[2-(2-methyl-4-oxopentyl)]-acrylamide and vinylidene chloride as an EAC layer.

An electrically activated recording element was prepared as described in Example 1 with the exception that layer 56 (EAC layer) consisted of poly(N-[2-(2-methyl-4-oxopentyl)]acrylamide-co-vinylidene chloride). The element was imagewise exposed and thermally processed as described in Example 1 to produce an image having 0.1 density at an exposure of 0.3 microcoulombs/cm$^2$.

EXAMPLE 12

This example illustrates the invention.

An electrically activated recording element was prepared as described in Example 2 with the exception that the layer 56 described in Example 2 was a poly(methyl acrylate-co-vinylidene chloride) (20:80 weight ratio) EAC layer. This layer was coated on the cermet layer at 1.33 ml per 929 cm$^2$ of support from a 1.5 percent by weight solution of the polymer in methyl ethyl ketone.

A charge exposure of 1.0 microcoulomb/cm$^2$ was necessary to produce a developed image having a maximum transmission density of 1.0.

This illustrates that an element according to the invention requires significantly less charge exposure to obtain a developed image having a desired maximum density than the elements described in Examples 1 through 9.

EXAMPLES 13 THROUGH 16

The procedure described in Example 12 was repeated, with the exception that layer 56 as described was a poly(methylacrylate-co-vinylidene chloride) having weight ratios as follows:

| | Weight Ratio | |
|---|---|---|
| Example 13 | 5:95 | (comparative example) |
| Example 14 | 10:90 | (comparative example) |
| Example 15 | 15:85 | |
| Example 16 | 30:70 | |

The results of these examples were as follows:

| | Exposure Level Required to Produce Maximum Density of 1.0 | |
|---|---|---|
| Example 13 | >10.0 | (comparative example) |
| Example 14 | 10.0 | (comparative example) |
| Example 15 | 1.5 | |
| Example 16 | 1.5 | |

In each of Examples 13, 14, 15 and 16, the resulting developed image has a maximum density of 1.0 and a minimum density of 0.22.

The invention has been described in detail with particular reference to preferred embodiments thereof, but it will be understood that variations and modifications can be effected within the spirit and scope of the invention.

What is claimed is:

1. In an electrically activatable recording element comprising an electrically conductive support having thereon, in sequence:

(a) a polymeric electrically active conductive layer, (b) an electrically activatable recording layer comprising:

(A) a dye-forming coupler, and (B) an oxidation-reduction combination comprising:

(i) an organic silver salt oxidizing agent consisting essentially of a silver salt of a 1,2,4-mercaptotriazole derivative with (ii) a reducing agent which, in its oxidized form, forms a dye with said dye-forming coupler, (c) a photoconductive layer separated from (b) by an air gap of up to 20 microns, and (d) an electrically conductive layer, the improvement wherein the polymeric electrically active conductive layer comprises a vinyl addition polymer comprising recurring units represented by the structure:

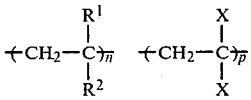

wherein $R^1$ is hydrogen or methyl; $R^2$ is aryl containing 6 to 10 carbon atoms, or:

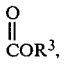

wherein $R^3$ is alkyl containing 1 to 20 carbon atoms or aryl containing 6 to 10 carbon atoms, each X is bromine or chlorine; n represents 15 to 50 weight percent, and p represents 50 to 85 weight percent of said vinyl addition polymer.

2. An electrically activatable recording element as in claim 1 wherein said vinyl addition polymer comprises recurring units represented by the structure:

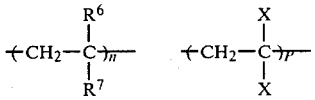

wherein $R^6$ is hydrogen or methyl; $R^7$ is:

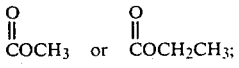

X is bromine or chlorine; n represents 15 to 50 weight percent of said vinyl addition polymer and p represents 50 to 85 weight percent of said vinyl addition polymer.

3. An electrically activatable recording element as in claim 1 wherein said vinyl addition polymer consists essentially of poly(methyl acrylate-co-vinylidene chloride) having a weight ratio of about 20 weight percent methyl acrylate units to about 80 weight percent vinylidene chloride units.

4. An electrically activatable recording element as in claim 1 wherein said polymeric electrically active conductive layer is about 0.02 to about 10 microns thick.

5. An electrically activatable recording element as in claim 1 wherein said 1,2,4-mercaptotriazole derivative is represented by the structure:

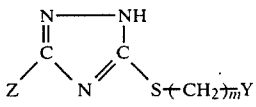

wherein Y is aryl containing 6 to 12 carbon atoms; m is 0 to 2; and Z is hydrogen, hydroxyl, or amine.

6. An electrically activatable recording element as in claim 1 wherein said electrically conductive support comprises a poly(ethylene terephthalate) film having thereon, in sequence, a subbing layer and an electrically conductive cermet layer.

7. An electrically activatable recording element as in claim 1 wherein said electrically activatable recording layer also comprises an electrically conductive polymeric binder.

8. An electrically activatable recording element as in claim 1 wherein said electrically activatable recording layer also comprises an electrically conductive binder consisting essentially of a poly(acrylamide).

9. In an electrically activatable recording element comprising a poly(ethylene terephthalate) film support having thereon a subbing layer comprising poly(methyl acrylate-co-vinylidene chloride-co-itaconic acid) and having on the subbing layer an electrically conductive cermet layer and having on said cermet layer, in sequence:

(a) a polymeric electrically active conductive layer, (b) an electrically activatable recording layer comprising, in an electrically conductive polyacrylamide binder, (A) a dye-forming coupler consisting essentially of a compound selected from the group consisting of 2,6-dihydroxyacetanilide and 2',6'-dihydroxytrifluoroacetanilide and combinations thereof, and (B) an oxidation-reduction combination consisting essentially of (i) an organic silver salt oxidizing agent consisting essentially of a silver salt of 3-amino-5-benzylthio-1,2,4-triazole, with (ii) a reducing agent consisting essentially of 4-amino-2-methoxy-N,N,5-trimethyl aniline sulfate, (c) a photoconductive layer separated from (b) by an air gap of up to 20 microns, and (d) an electrically conductive layer, the improvement wherein the polymeric electrically activated conductive layer consists essentially of poly(methyl acrylate-co-vinylidene chloride) having a weight ratio of about 20 weight percent methyl acrylate units to about 80 weight percent vinylidene chloride units.

10. In an electrically activatable recording element comprising an electrically conductive support having thereon, in sequence:

(a) a polymeric electrically active conductive layer, (b) an electrically activated recording layer comprising (A) a dye-forming coupler, and (B) an oxidation-reduction combination comprising (i) an organic silver salt oxidizing agent consisting essentially of a silver salt of a 1,2,4-mercaptotriazole derivative with (ii) a reducing agent which, in its oxidized form, forms a dye with said dye-forming coupler, the improvement wherein the polymeric electrically active conductive layer consists essentially of a vinyl addition polymer comprising recurring units represented by the structure:

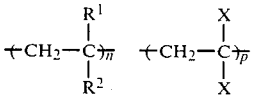

wherein $R^1$ is hydrogen or methyl; $R^2$ is aryl containing 6 to 10 carbon atoms, or:

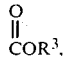

wherein $R^3$ is alkyl containing 1 to 20 carbon atoms or aryl containing 6 to 10 carbon atoms, X is bromine or chlorine; n represents 15 to 50 weight percent, and p represents 50 to 85 weight percent of said vinyl addition polymer.

11. An electrically activatable recording element as in claim 10 wherein said vinyl addition polymer comprises recurring units represented by the structure:

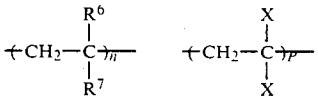

wherein $R^6$ is hydrogen or methyl; $R^7$ is:

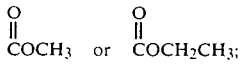

X is bromine or chlorine; n represents 15 to 50 weight percent of said vinyl addition polymer and p represents 50 to 85 weight percent of said vinyl addition polymer.

12. An electrically activatable recording element as in claim 10 wherein said vinyl addition polymer consists essentially of poly(methyl acrylate-co-vinylidene chloride) having a weight ratio of about 20 weight percent methyl acrylate units to about 80 weight percent vinylidene chloride units.

13. An electrically activatable recording element as in claim 10 wherein said 1,2,4-mercaptotriazole derivative is represented by the structure:

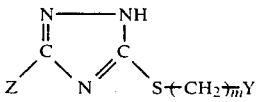

wherein Y is aryl containing 6 to 12 carbon atoms; m is 0 to 2; and Z is hydrogen, hydroxyl, or amine.

14. In an electrically activatable recording element comprising a poly(ethylene terephthalate) film support having thereon a subbing layer comprising poly(methyl acrylate-co-vinylidene chloride-co-itaconic acid) and having on the subbing layer an electrically conductive cermet layer and having on the cermet layer, in sequence:

(a) a polymeric electrically active conductive layer, (b) an electrically activated recording layer comprising, in an electrically conductive polyacrylamide binder, (A) a dye-forming coupler consisting essentially of a compound selected from the group consisting of 2,6-dihydroxyacetanilide and 2',6'-dihydroxytrifluoroacetanilide and combinations thereof, and (B) an oxidation-reduction combination consisting essentially of (i) an organic silver salt oxidizing agent consisting essentially of a silver salt of 3-amino-5-benzylthio-1,2,4-triazole, with (ii) a reducing agent consisting essentially of 4-amino-2-methoxy-N,N,5-trimethyl aniline sulfate, the improvement wherein the polymeric electrically active conductive layer consists essentially of poly(methyl acrylate-co-vinylidene chloride) having a weight ratio of about 20 weight percent methyl acrylate units and about 80 weight percent vinylidene chloride units.

15. A dry, electrically activatable recording process for producing a dye enhanced silver image in an electrically activatable recording element comprising an electrically conductive support having thereon, in sequence:

(a) a polymeric electrically active conductive layer consisting essentially of a vinyl addition polymer comprising recurring units represented by the structure:

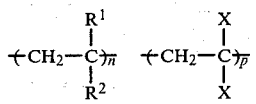

wherein $R^1$ is hydrogen or methyl; $R^2$ is aryl containing 6 to 10 carbon atoms, or

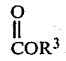

wherein $R^3$ is alkyl containing 1 to 20 carbon atoms or aryl containing 6 to 10 carbon atoms, $R^4$ and $R^5$ are individually selected from hydrogen and alkyl containing 1 to 4 carbon atoms; X is bromine or chlorine; n represents 15 to 50 weight percent and p represents 50 to 85 weight percent of said vinyl addition polymer;

(b) an electrically activatable recording layer comprising (A) a dye-forming coupler, and (B) an oxidation-reduction combination comprising (i) an organic silver salt oxidizing agent consisting essentially of a silver salt of a 1,2,4-mercaptotriazole derivative with (ii) a reducing agent which, in its oxidized form, forms a dye with said dye-forming coupler, said process comprising the steps of:

(I) applying an electrical potential imagewise to said recording element of a magnitude and for a time sufficient to produce in the image areas a charge density within the range of about $10^{-5}$ coulomb per $cm^2$ to about $10^{-8}$ coulomb per $cm^2$, said charge density forming a latent image in the image-forming combination; and (II) heating said recording element substantially uniformly at a temperature and for a time sufficient to develop a dye enhanced silver image in said recording layer.

16. A dry, electrically activatable recording process for producing a dye enhanced silver image in an electrically activatable recording element comprising, in sequence:

(a) an electrically conductive layer, (b) a photoconductive layer, (c) an electrically activatable recording layer separated from (b) by an air gap of up to 20 microns and comprising, in an electrically conductive binder, in reactive association:

(A) a dye-forming coupler, and (B) an oxidation-reduction combination comprising (i) an organic silver salt oxidizing agent consisting essentially of a silver salt of a 1,2,4-mercaptotriazole derivative with (ii) a reducing agent which, in its oxidized form, forms a dye with said dye-forming coupler, (d) a polymeric electrically active conductive layer consisting essentially of a vinyl addition polymer comprising recurring units represented by the structure:

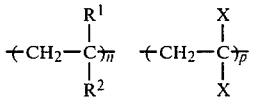

wherein $R^1$ is hydrogen or methyl; $R^2$ is aryl containing 6 to 10 carbon atoms, or

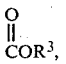

wherein $R^3$ is alkyl containing 1 to 4 carbon atoms; X is bromine or chlorine; n represents 15 to 50 weight percent and p represents 50 to 85 weight percent of said vinyl addition polymer;

(e) an electrically conductive support; said process comprising the steps of:

(I) imagewise altering the conductivity of said photoconductive layer in accord with an image to be recorded;

(II) applying an electrical potential across said photoconductive layer and said recording layer of a magnitude and for a time sufficient to produce a latent image in said recording layer corresponding to the image to be recorded; and, (III) heating said recording layer substantially uniformly at a temperature and for a time sufficient to produce a dye enhanced silver image in said recording layer.

17. A process as in claim 16 wherein said recording layer is heated in (III) to a temperature within the range of about 100° C. to about 180° C. until a dye enhanced silver image is produced in said recording layer.

18. A dry, electrically activatable recording process for producing a dye enhanced silver image in an electrically activatable recording element comprising, in sequence:

(a) a first transparent support having thereon (b) a first electrically conductive layer, and (c) a photoconductive layer, having thereover (d) an electrically activatable recording layer separated from (c) by an air gap of up to 20 microns, and comprising, in an electrically conductive polyacrylamide binder, (A) a dye-forming coupler consisting essentially of a compound selected from the group consisting of 2,6-dihydroxyacetanilide and 2′,6′-dihydroxytrifluoroacetanilide and combinations thereof, (B) an oxidation-reduction combination comprising (i) an organic silver salt oxidizing agent consisting essentially of a silver salt of 3-amino-5-benzylthio-1,2,4-triazole, with (ii) a reducing agent consisting essentially of 4-amino-2-methoxy-N,N,5-trimethyl aniline sulfate, (e) a polymeric electrically active conductive layer consisting essentially of poly(methyl acrylate-co-vinylidene chloride) having a weight ratio of about 20 weight percent methyl acrylate units to about 80 weight percent vinylidene chloride units, (f) an electrically conductive cermet layer, and (g) a second support, said process comprising the steps of:

(I) imagewise altering the conductivity of said photoconductive layer in accord with an image to be recorded;

(II) applying an electrical potential across said photoconductive layer and recording layer of a magnitude and for a time sufficient to produce a latent image in said recording layer corresponding to said image to be recorded; and, (III) heating said recording layer substantially uniformly at a temperature and for a time sufficient to produce a dye enhanced silver image in said recording layer.

19. A process as in claim 18 wherein said recording layer is heated in (III) to a temperature within the range of about 100° C. to about 180° C. until a dye enhanced silver image is produced in said recording layer.

20. A dry, electrically activatable recording process for producing a dye enhanced silver image in an electrically activatable recording element comprising the steps of:

(I) imagewise altering the conductivity of a photoconductive layer in accord with an image to be recorded;

(II) positioning the imagewise altered photoconductive layer from (I) within 20 microns adjacent an electrically activated recording layer of said electrically activated recording element, said element comprising an electrically conductive support having thereon, in sequence:

(a) a polymeric electrically active conductive layer consisting essentially of a vinyl addition polymer comprising recurring units represented by the structure:

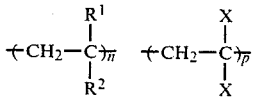

wherein $R^1$ is hydrogen or methyl; $R^2$ is aryl containing 6 to 10 carbon atoms, or

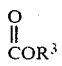

wherein $R^3$ is alkyl containing 1 to 20 carbon atoms or aryl containing 6 to 10 carbon atoms, X is bromine or chlorine; n represents 15 to 50 weight percent, and p represents 50 to 85 weight percent of said vinyl addition polymer; and (b) said electrically activatable recording layer comprising (A) a dye-forming coupler, and (B) an oxidation-reduction combination comprising (i) an organic silver salt oxidizing agent consisting essentially of a silver salt of a 1,2,4-mercaptotriazole derivative with (ii) a reducing agent which, in its oxidized form, forms a dye with said dye-forming coupler, (III) applying an electrical potential across said photoconductive layer and recording layer of a magnitude and for a sufficient time to produce in the areas of said recording layer corresponding to the imagewise altered portions of said photoconductive layer a charge density within the range of about $10^{-5}$ coulomb/cm$^2$ to about $10^{-8}$ coulomb/cm$^2$, said charge density forming in said areas a latent image; and, (IV) uniformly heating the recording element at a temperature and for a time sufficient to produce a dye enhanced silver image in said recording element.

21. A dry, electrically activatable recording process as in claim 20 also comprising the steps:

(V) positioning said imagewise altered photoconductive layer within 20 microns adjacent a second electrically activated recording layer;

(VI) applying an electrical potential across said photoconductive layer and said second recording layer of a magnitude and for a sufficient time to produce in the imagewise altered portions of said photoconductive layer a charge density within the range of about $10^{-5}$ coulomb/cm$^2$ to about $10^{-8}$ coulomb/cm$^2$, said charge density forming a latent image; and, (VII) uniformly heating said second recording layer at a temperature and for a time sufficient to produce a developed image in said second recording layer.

22. A dry, electrically activatable recording process for producing a dye enhanced silver image in an electrically activated recording element comprising on an electrically conductive support, in sequence:

(a) a polymeric electrically active conductive layer consisting essentially of a vinyl addition polymer comprising recurring units represented by the structure:

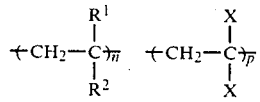

wherein $R^1$ is hydrogen or methyl; $R^2$ is aryl containing 6 to 10 carbon atoms, or

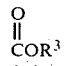

wherein $R^3$ is alkyl containing 1 to 20 carbon atoms or aryl containing 6 to 10 carbon atoms, X is bromine or chlorine; n represents 15 to 50 weight percent, and p represents 50 to 85 weight percent of said vinyl addition polymer; and (b) an electrically activatable recording layer comprising (A) a dye-forming coupler, and (B) an oxidation-reduction combination comprising (i) an organic silver salt oxidizing agent consisting essentially of a silver salt of a 1,2,4-mercaptotriazole derivative with (ii) a reducing agent which, in its oxidized form, forms a dye with said dye-forming coupler, said process comprising the steps of:

(I) positioning said recording element in face-to-face relationship with a photoconductive element wherein said recording element is separated from said photoconductive element by an air gap of up to 20 microns;

(II) exposing said photoconductive element to an imagewise pattern of actinic radiation while simultaneously applying an electrical potential having a field strength of at least about $1\times10^3$ volts/cm across said photoconductive element and said recording element for a sufficient time to provide a latent image in the areas of said recording element corresponding to the exposed areas of said photoconductive element; and (III) substantially uniformly heating the recording element at a temperature and for a time sufficient to produce a dye enhanced silver image in said recording element.

23. A process as in claim 22 wherein said recording element in (III) is heated to a temperature within the range of about 100° C. to about 180° C. until a dye enhanced silver image is produced.

24. A process as in claim 22 wherein said photoconductive element is X-ray sensitive and the conductivity of said element is imagewise altered by exposing said photoconductive element to X-ray radiation in accord with an image to be recorded.

25. A process as in claim 22 wherein said vinyl addition polymer consists essentially of poly(methyl acrylate-co-vinylidene chloride) having a weight ratio of about 20 weight percent methyl acrylate units to about 80 weight percent vinylidene chloride units.

26. A dry, electrically activatable recording process for producing a dye enhanced silver image in an electrically activatable recording element comprising an electrically conductive support having thereon, in sequence:

(a) a polymeric electrically active conductive layer consisting essentially of a vinyl addition polymer comprising recurring units represented by the structure:

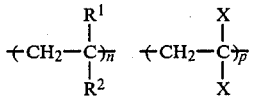

wherein $R^1$ is hydrogen or methyl; $R^2$ is aryl containing 6 to 10 carbon atoms, or

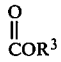

wherein $R^3$ is alkyl containing 1 to 20 carbon atoms or aryl containing 6 to 10 carbon atoms, X is bromine or chlorine; n represents 15 to 50 weight percent, and p represents 50 to 85 weight percent of said vinyl addition polymer; and (b) an electrically activatable recording layer comprising (A) a dye-forming coupler, and (B) an oxidation-reduction combination comprising (i) an organic silver salt oxidizing agent consisting essentially of a silver salt of a 1,2,4-mercaptotriazole derivative with (ii) a reducing agent which, in its oxidized form, forms a dye with said dye-forming coupler, said process comprising the steps of:

(I) positioning said recording element on an electrically conductive backing member;

(II) modulating a corona ion current flow to the recording element by an electrostatic field established imagewise between an image grid comprising an electroconductive core sequentially connectable to sources of different potential relative to said backing member and covered with a coating of a photoconductive insulating material and a control grid that is electrically conductive and sequentially connectable to sources of different potential relative to said backing member, said current flow being of a magnitude sufficient to produce a charge density within the range of about $10^{-5}$ to about $10^{-8}$ coulomb/cm$^2$ imagewise in said recording element, which charge density forms a latent image in said electrically activated recording material; and, (III) substantially uniformly heating said recording element at a temperature and for a sufficient time to produce a dye enhanced silver image in said recording element.

27. In an electrically activatable recording element comprising a polymeric electrically active conductive layer, the improvement wherein the polymeric electrically active conductive layer comprises a vinyl addition polymer that provides increased sensitivity to said element comprises recurring units represented by the structure:

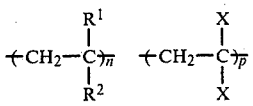

wherein $R^1$ is hydrogen or methyl; $R^2$ is aryl containing 6 to 10 carbon atoms, or:

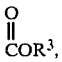

wherein $R^3$ is alkyl containing 1 to 20 carbon atoms or aryl containing 6 to 10 carbon atoms, each X is bromine or chlorine; n represents 15 to 50 weight percent, and p represents 50 to 85 weight percent of said vinyl addition polymer.

28. In an electrically activatable recording element comprising a polymeric electrically active conductive layer, the improvement wherein the polymeric electrically active conductive layer consists essentially of poly(methyl acrylate-co-vinylidene chloride) having a weight ratio of about 20 weight percent methyl acrylate units to about 80 weight percent vinylidene chloride units and provides increased sensitivity to said element.

* * * * *